United States Patent [19]

Hill

[11] Patent Number: 4,893,676

[45] Date of Patent: Jan. 16, 1990

[54] WELL TREATING METHOD AND ASSOCIATED APPARATUS FOR STIMULATING RECOVERY OF PRODUCTION FLUIDS

[75] Inventor: Gilman A. Hill, 7128 S. Poplar La., Englewood, Colo. 80112

[73] Assignee: Gilman A. Hill, Englewood, Colo.

[21] Appl. No.: 317,623

[22] Filed: Feb. 28, 1989

Related U.S. Application Data

[63] Continuation-in-part of Ser. No. 139,614, Dec. 30, 1987, Pat. No. 4,823,875, which is a continuation-in-part of Ser. No. 943,551, Dec. 18, 1986, Pat. No. 4,718,493, which is a continuation-in-part of Ser. No. 686,990, Dec. 27, 1984, Pat. No. 4,633,951.

[51] Int. Cl.[4] ..... E21B 33/138; E21B 33/16; E21B 43/267

[52] U.S. Cl. ..... 166/280; 166/153; 166/284; 166/291; 166/308

[58] Field of Search ..... 166/153, 291, 284, 308, 166/271, 281, 283, 285, 297, 298; 15/104.061; 406/50, 197; 137/1, 15

[56] References Cited

U.S. PATENT DOCUMENTS

| | | | |
|---|---|---|---|
| 3,826,310 | 7/1974 | Karnes | 166/291 |
| 3,875,606 | 4/1975 | Landers | 15/104.061 |
| 4,003,393 | 1/1977 | Jaggard et al. | 15/104.061 X |
| 4,078,609 | 3/1978 | Pavlich | 166/280 X |
| 4,303,300 | 12/1981 | Watson | 166/291 |
| 4,391,337 | 7/1983 | Ford et al. | 175/4.6 |
| 4,421,167 | 12/1983 | Erbstoesser et al. | 166/284 X |
| 4,543,131 | 9/1985 | Purinton, Jr. | 15/104.061 X |
| 4,633,951 | 1/1987 | Hill et al. | 166/297 X |
| 4,674,573 | 6/1987 | Bode | 166/291 |
| 4,718,493 | 1/1988 | Hill et al. | 166/308 |

*Primary Examiner*—Stephen J. Novosad

*Attorney, Agent, or Firm*—Hubbard, Thurman, Turner, Tucker & Harris

[57] ABSTRACT

Subterranean oil and gas producing formations are fractured at vertically spaced intervals utilizing perforating guns forced down the well casing in tailing off "trains" comprising tamping and spacing water columns respectively positioned above and below each perforating gun, a perforation plugging slurry positioned below the spacing water column, and a concentrated proppant slurry column positioned below the perforation plugging slurry column. The perforation plugging and proppant slurry columns are sealed at their upper and lower ends by specially designed gel plug seals each comprising a short column of strong gel solution in which a spaced pair of casing size rock salt balls are disposed to provide the seal with structural reinforcement. As a tailing off train reaches a previous casing perforation zone, the concentrated proppant slurry flows outwardly through the perforations to prop the adjacent fracture zone, and the gel plug balls and the perforating slurry form a plug-off structure which seals the perforations, thereby automatically positioning the gun for a subsequent casing perforation shot. The guns and gel plug components of one or more gun and fluid column trains are stored in a vertically elongated well head lubricator pipe structure, and an associated fluid injection and displacement system is used to rapidly form each train and drive it down the casing. By adjusting the length of the spacing water column, the fracture spacing intervals may be easily varied.

34 Claims, 4 Drawing Sheets

WELL TREATING METHOD AND ASSOCIATED APPARATUS FOR STIMULATING RECOVERY OF PRODUCTION FLUIDS

CROSS-REFERENCE TO RELATED APPLICATIONS

This application is a continuation-in-part of U.S. application Ser. No. 139,614 filed on Dec. 30, 1987 which was a continuation-in-part of U.S. application Ser. No. 943,551 filed on Dec. 18, 1986, now U.S. Pat. No. 4,718,493, which was a continuation-in-part of U.S. application Ser. No. 686,990 filed on Dec. 27, 1984, now U.S. Pat. No. 4,633,951. The disclosures of such prior application and patents are hereby incorporated herein by reference.

BACKGROUND OF THE INVENTION

The present invention relates generally to apparatus and methods for fracturing subterranean oil and gas producing formations to stimulate production fluid recovery therefrom. In a preferred embodiment thereof, the present invention more particularly provides improved apparatus and methods for forming casing perforation sealing structures and positioning perforation guns for subsequent casing perforation and earth fracturing at progressively higher levels along a well casing.

The general process of hydraulically fracturing vertically spaced zones of subterranean oil and gas producing formations, through spaced series of well casing perforation areas, to stimulate production fluid recovery is widely known and utilized in various forms. A conventional method comprises the lowering, on a wireline, of an explosive perforating gun containing shaped charges to a predetermined depth within a fracturing fluid-filled well casing. Electric detonation of the gun creates perforations in the casing through which the frac fluid is outwardly forced, by surface pumping equipment, to hydraulically fracture the adjacent subterranean formation.

As illustrated and described in U.S. Pat. Nos. 4,633,951 and 4,718,493, this general perforation and fracturing technique has been substantially improved via the incorporation of a "foam decompression fracturing" (FDF) process in which a gas is injected into the frac fluid to foam and highly pressurize it prior to detonation of the perforating gun. After the gun is fired, the highly pressurized frac foam exits the resulting casing perforations at near sonic velocity, releasing its great amount of stored compressive energy to greatly facilitate the fracturing of the adjacent subterranean formation.

After this initial fracture zone has been formed, by one of the above-described methods, the fractures therein are "propped" with a quantity of proppant fluid flowed outwardly through the casing perforations, and a "sand-off" operation is performed to plug the perforations. This sequence of casing perforation, fracturing, propping, and perforation plugging is then repeated at successively higher spaced locations along the well casing. When the fracing operation is complete, the perforation plug structures previously formed are removed in a suitable manner to permit enhanced fluid flow from the fracture zones into the casing, through the now unblocked perforation zones therein, for delivery up to the surface-disposed well head in the usual manner.

Critical to the success of this sequential fracturing process is the efficient and reliable formation of the perforation plugging structures at spaced intervals within the casing after the proppant fluid has been delivered to the fracture spaces. In the past, various attempts have been made to form, and precisely locate, these perforation plugging structures within the well casing by flowing a column of perforation plugging slurry downwardly through the casing directly above the fracture proppant fluid and directly beneath a column of driving fluid.

The theory behind this "stacked column" approach to fracture propping and perforation plugging is that after the proppant fluid, and a portion of the perforation plugging slurry, has flowed outwardly through the casing perforations, the plugging slurry will block the perforations and form a casing "plug" structure which extends a short distance upwardly past the upper end of the perforation zone. This plug structure (if successfully formed) defines, in effect, a new "support bottom" portion of the casing above which a subsequent perforation zone may be formed to continue the sequential fracturing operations along the casing.

Difficulties have been encountered, however, in creating these casing plug structures using stacked casing fluid columns. Specifically, in the process of transporting the plugging slurry down-hole, there has tended to be dilution of the plugging slurry due to mixing thereof with fluids above and below it which resulted in an undesirable and quite unpredictable distribution of the plugging slurry content over a long transition zone within the casing. Such dilution and mixing of the plugging slurry with other well bore fluids creates imprecision and uncertainty about achieving a perforation plug-off, and can cause a premature plug-off prior to the desired fluid displacement outflow volume through the perforations. Alternatively, the plug-off may be delayed until long after the calculated displacement volume outflow. Or, a complete plug-off might not even be effected by the slug of perforation plugging slurry which becomes diluted and dispersed during its transit down the casing.

Most prior attempts to circulate slugs of perforation plugging slurries down a long well casing have resulted in failure to achieve a plug-off or, more often, have produced gross inaccuracies in the volumetric displacement of plugging slurries so that the volumetric displacement position of effective plug-off is not achieved. Also, subsequent fall-out of the bypassed solids from the lower slurries, when mixed with the upper fluids, has tended to create an unpredictable casing fill-up of settled-out solids on top of the perforation plug. This excessive casing fill-up from bypassed solids has often made it impossible for the next perforating gun run in the hole to reach the target zone for the next perforation.

These undesirable results stem primarily from the fact that during the flow of the initially stratified slurry and fluid columns down a long casing string, the center of each fluid column is flowing at a much higher velocity than the periphery of the fluid column in the shear zone near the casing wall. Consequently, the fluid near the casing wall has the composition of the fluid from lower down in the column stack. Conversely, the fluid near the center of the casing has the composition of the fluid from higher up in the column stack.

The fluid moving at the higher velociy along the center core of a given fluid column is rushing ahead to invade the next lower slug of fluid. That lower slug of fluid being invaded at the center core is also being retarded by the shearing forces near the casing wall so that it gets strung out along the casing wall through a long transition or mixing zone. Therefore, some of the perforation plugging slurry reaches the target perforation zone in a very diluted form far ahead of its predicted displacement according to time and volume calculations. Likewise, the fluid from the lower segments of the fluid column stack gets strung out along the casing wall for long distances. This tends to greatly dilute the perforation plugging slurry for a considerable distance above and below its calculated displacement position.

To fully appreciate the problems presented in accurately and reliably forming appropriate casing plug structures at each successive perforation zone along the well casing, it must be realized that the plugging "target" is an eight to ten foot perforated casing section located many hundreds or thousands of feet down the well casing. To reliably hit and plug this perforation target, without interfering with the placement of the next perforation gun, requires that a precisely measured amount of plugging slurry be sent down-hole and then caused to interact with the perforation zone in just the right manner.

Conventional attempts to perform this down-hole task have been noticeably less than satisfactory. It is accordingly an object of the present invention to provide an improved method of more reliably and accurately forming these casing plug structures.

SUMMARY OF THE INVENTION

In carrying out principles of the present invention, in accordance with a preferred embodiment thereof, improved methods and apparatus are provided for more accurately and reliably forming plug-off structures at the successively formed, vertically spaced casing perforation zones created in a sequential earth fracturing process used for the purpose of enhancing production fluid inflow to the casing for delivery to its associated well head.

This improved perforation plug-off technique is performed using a specially designed, elongated vertical lubricator pipe structure which forms an upper portion of the overall well head structure and communicates with the interior of the casing. The lubricator pipe structure is initially filled with a high strength sealing gel material which supports at spaced intervals within the lubricator pipe multiple pairs of casing-sized rock salt sealing balls and a pair of elongated perforating guns.

Operatively coupled to the lubricator pipe structure is a fluid injection and metering system which is used to inject precisely metered volumes of displacement fluid, proppant slurry and perforation plugging slurry into the pipe structure, in a predetermined sequence and at various locations therein, to form and deliver to the casing one or more tailing off trains. Each of the trains, from top to bottom, may comprise some or all of the following components: a tamp water column, one of the perforating guns, an upper gel plug, a column of perforation plugging slurry, an intermediate gel plug, a column of concentrated proppant slurry, and a lower gel plug.

Each of the three gel plugs in a given tailing off train comprises a short column of the high strength sealing gel material previously contained within the lubricator pipe structure, and one pair of the rock salt balls positioned in a spaced relationship within a longitudinally intermediate portion of the short gel column to structurally reinforce it. The three gel plugs function to isolate each of the two slurry columns in a given tailing off train from the fluid column above it and the fluid column below it. In this manner, as a given train is driven down the casing in a tailing off operation its two slurry columns are flowed "plug-like" down the casing with no appreciable amount of undesirable intermixing between either slurry column and either fluid column immediately adjacent thereto.

After a previous perforation gun has been used to create a casing perforation zone, and an adjacent earth fracture zone has been formed using pressurized frac fluid within the casing, one of the tailing off trains is formed and forced downwardly through the casing from the lubricator pipe structure. As the lower end of the train passes through the casing perforation zone the lower gel plug balls come to rest at and block a lower end of the perforation zone. The concentrated proppant slurry between the lower end intermediate gel plugs is then squeezed outwardly through the casing perforation zone, to more fully "prop" the fracture zone, until the intermediate gel plug ball pair come to rest atop the lower sealing ball pair.

Shortly after this occurs, the plugging slurry effectively plugs a portion of the perforation zone and the stopped sealing ball pairs blocks the balance of the perforations, thereby stopping the downward movement of the upper gel plug several feet above the top of the perforation zone. This creates a very effective, and very accurately placed, sealing plug structure within the casing which extends from the bottom of the previously formed perforation zone to several feet above its top end.

The formation of this sealing plug structure, in turn, positions the train's perforating gun a predetermined height above the now plugged perforation zone—as determined by the precalculated height of the spacing water column—to ready the casing for the next perforation shot.

In a preferred embodiment thereof, the fluid injection and metering system, which is used to inject displacement fluid, concentrated proppant slurry and plugging slurry into the lubrication pipe structure, includes first and second metering vessels. Each of the metering vessels has a displacement member therein, such as a diaphragm, which may be pressure "stroked" between opposite limit positions to discharge a precisely metered volume of fluid (equal to the internal volume of the vessel) from one side of the displacement member in response to a corresponding driving fluid volume inflow to the vessel on the other side of its displacement member.

The opposite inlets and outlets of the first and second metering vessels are operatively connected to various inlets in the lubricator pipe structure by a valved piping system which is connected to a pressurized source of low compressibility salt water solution used to downwardly displace, in predetermined sequences and combinations, each train's gun, sealing ball and associated gel column components stored within the lubricator pipe structure, and to form the tamp water and spacing water columns. The valved piping system also connects the opposite inlet and outlet of the second metering vessel to pressurized sources of concentrated proppant slurry and perforation plugging slurry used to form the corresponding slurry columns in each tailing off train.

To form a given tailing off train and force it downwardly into an upper end portion of the casing, the vessel piping system valves are sequenced to load and stroke the two metering vessels in a manner progressively moving the stored train components downwardly through the lubricator pipe structure and sequentially injecting between and adjacent appropriate train components the proppant slurry column, the plugging slurry column, the spacing water column and the tamp water column. As a given train is being progressively formed in this fashion, it enters the well casing and is progressively lowered therein.

When the train is completely formed, one of the metering vessels is stroked to move the train downwardly past the well head frac injection inlet. Frac fluid is then injected into the casing to drive the train downwardly therethrough to a previously created perforation zone to perform the tailing off and plugging operation described above.

The sequencing of the metering vessel piping system valves may be appropriately automated to eliminate human error and to permit the entire train formation, tailing off and plugging, and second gun placement process to accomplished within a very short time after a previous perforation gun shot within the casing. Coupled with the accuracy and reliability of the plug structure formation, and the volumetric precision of the injection, this train formation and loading rapidity greatly facilitates the use of the "second-shot" fracturing process in which a second fracture zone is formed closely adjacent and very shortly after the creation of a first fracture zone.

DETAILED DESCRIPTION

Figure 1:
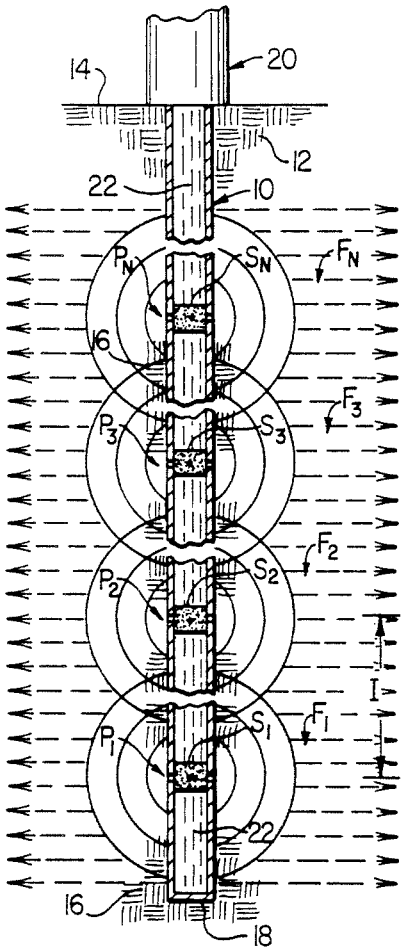
FIG. 1 is a schematic, longitudinally foreshortened cross-sectional view through an underground well casing after vertically spaced perforation zones have been formed therein and used to create corresponding fracture zones in a production fluid-bearing formation adjacent thereto, and schematically illustrates vertically spaced perforation plugging structures $S_1$–$S_N$ formed by a unique method of the present invention.

Schematically illustrated in FIG. 1, in longitudinally foreshortened form, is an elongated well casing 10 which extends downwardly through the earth 12 many hundreds or thousands of feet, as the case may be, from the earth's surface 14 into a production fluid-bearing subterranean formation 16 from which oil and/or natural gas may be recovered. Well casing 10 has a lower end 18, and is operatively connected at its upper end to a surface well head structure 20.

To enhance the production fluid recovery from the subterranean formation 16, a suitable fracturing fluid 22 (commonly referred to as "frac" fluid) is flowed into the casing 10 and used in conjunction with a series of perforation guns (not shown) to sequentially form in the casing a vertically spaced series of perforation zones $P_1$–$P_N$ (spaced at the representative interval "I" of any desired distance through which the frac fluid 22 is forced outwardly to form production fluid flow-enhancing fracture zones $F_1$–$F_N$ respectively adjacent and extending outwardly around the peripheries of the perforation zones $P_1$–$P_N$.

After each vertically successive perforation zone and its associated fracture zone are formed, a suitable proppant fluid is flowed outwardly through the casing perforations into the fracture area, and one of the perforation plug-off structures $S_1$–$S_N$ is formed at the particular perforation zone to ready the casing 10 for the formation of the next vertically successive perforation zone and its associated fracture zone, and the plug-off of the next perforation zone with the next plug-off structure.

After each vertically successive perforation zone is formed, its adjacent fracture zone may be created by using conventional surface pumping equipment (not shown) to force the frac fluid outwardly through the casing perforations at high pressure to hydraulically create the particular fracture zone. Alternatively, as illustrated and described in U.S. Pat. Nos. 4,633,951 and 4,718,493, the fracturing operations may be performed utilizing a "foam decompression fracturing" (FDF) process in which a gas is injected into the casing-contained frac fluid to foam and highly pressurize it prior to the detonation of the perforating gun. After the gun is fired, the highly pressurized frac foam exits the resulting casing perforations at near sonic velocity, rapidly releasing its great amount of stored compressive energy to greatly facilitate the fracturing of the adjacent subterranean formation.

Figure 2:
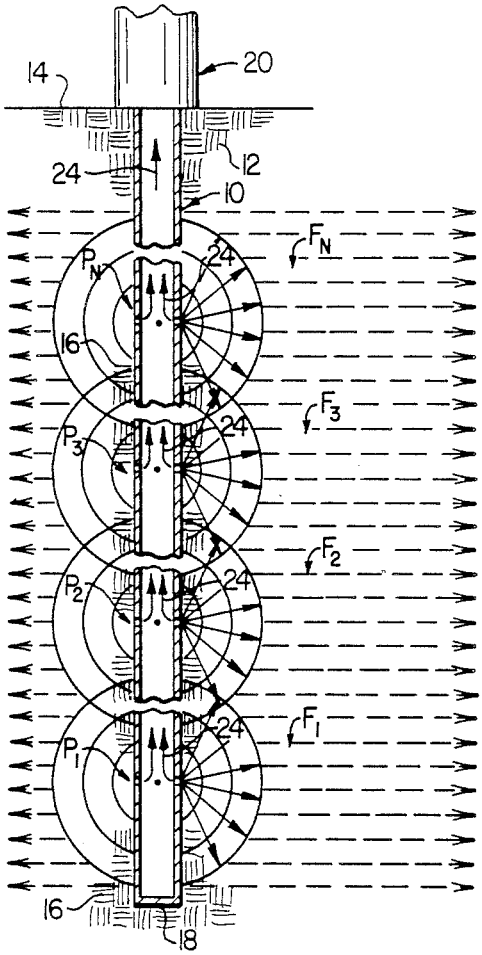
FIG. 2 is a view similar to that in FIG. 1, but with the plugging structures removed and production fluid flowing inwardly through the now uncovered perforations and upwardly through the casing to its associated well head.

As schematically illustrated in FIG. 2, after each of the perforation plug-off structures $S_1$–$S_N$ has been formed, the plug-off structures are suitably drilled out, or otherwise removed, to permit production fluid 24 to flow into the casing 10, through the now re-opened perforation zones $P_1$–$P_N$, and be delivered upwardly to the well head 20 into the normal manner.

The effectiveness of this sequential perforation, fracturing, propping, and plugging process carried on at vertical intervals "I" along the casing 10 is dependent, to a large extent, on reliably and accurately forming the plug-off structures $S_1$–$S_N$ along the appropriate longitudinal portion of casing. For example, if a particular plug-off structure is not properly formed, or if it extends too high or becomes too diluted to create an effective plug-off, then the subsequent perforating gun placement at a desired vertical location in the casing can be delayed, or rendered unfeasible. To appreciate the difficulty in forming these plug-off structures, it must be realized that each perforation zone to be plugged presents a "target" which may be many hundreds or thousands of feet down the casing, yet is only approximately eight to ten feet long. In the past, various attempts have been made to form, and precisely locate, these perforation plugging structures within the well casing by flowing a column of perforation plugging slurry downwardly through the casing directly above a column of fracture proppant fluid and directly beneath a column of driving fluid.

The theory behind this "stacked column" approach to fracture propping and perforation plugging is that after the concentrated proppant fluid, and a portion of the perforation plugging slurry, has flowed outwardly through the casing perforations in a particular perforation zone, the plugging slurry will block the perforations and form a casing "plug" structure which extends a short distance upwardly past the upper end of the perforation zone. This plug structure (if successfully formed) defines, in effect, a new "support bottom" portion of the casing above which a subsequent perforation zone may be formed to continue the sequential fracturing operations along the casing.

Difficulties have been encountered, however, in creating these casing plug structures using stacked casing fluid columns. Specifically, in the process of transporting the plugging slurry down-hole, there has tended to be dilution of the plugging slurry due to mixing thereof with fluids above and below it which resulted in an undesirable and quite unpredictable distribution of the plugging slurry content over the long transition zone. Such dilution and mixing with other well bore fluids creates imprecision and uncertainty about achieving a perforation plug-off.

For example, this dilution and mixing of well bore fluids between the stacked columns can cause a premature plug-off prior to the desired fluid displacement outflow volume through the perforations. Alternatively, the plug-off may be delayed until long after the calculated displacement volume outflow. Or, the complete effective plug-off might not even be formed by the slug of perforation plugging slurry which becomes diluted and dispersed during its transit down the casing.

Most prior attempts to circulate slugs of perforation plugging slurries down a long well casing have resulted in failure to achieve a plug-off or, more often, have produced gross inaccuracies in the volumetric displacement of plugging slurries so that the volumetric displacement position of effective plug-off is not achieved. Also, subsequent fall-out of the bypassed solids from the lower slurries, when mixed with the upper fluids, has tended to create an unpredictable casing fill-up of settled-out solids on top of the perforation plug. This excessive casing fill-up from bypassed solids has often made it impossible for the next perforating gun run in the hole to reach the target zone for the next perforation.

These undesirable results stem primarily from the fact that during the flow of the initially stratified slurry and fluid columns down a long casing string, the center of each fluid column is flowing at a much higher velocity than the periphery of the fluid column in the shear zone near the casing wall. Consequently, the fluid near the casing wall has the composition of the fluid from lower down in the column stack. Conversely, the fluid near the center of the casing has the composition of the fluid from higher up in the column stack.

The fluid moving at the higher velocity along the center core of a given fluid column is rushing ahead to invade the next lower slug of fluid. That lower slug of fluid being invaded at the center core is also being retarded by the shearing forces near the casing wall so that it gets strung out along the casing wall through a long transition or mixing zone. Therefore, some of the perforation plugging slurry reaches the target perforation zone in a very diluted form far ahead of its predicted displacement according to time and volume calculations. Likewise, the fluid from the lower segments of the fluid column stack gets strung out along the casing wall for long distances. This tends to greatly dilute the perforation plugging slurry for a considerable distance above and below its calculated displacement position.

Figure 3:
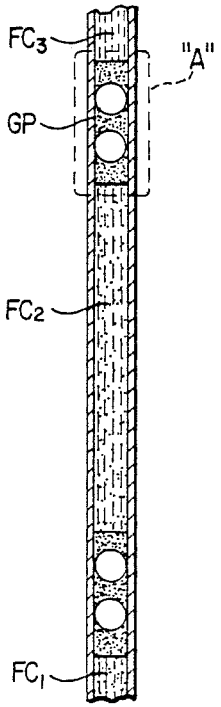
FIG. 3 is a cross-sectional view through a casing portion and illustrates a pair of gel/ball "plugs" used to separate various vertical columns of "tailing off" fluids used in fracture propping and perforation plugging portions of the fracturing methods of the present invention.
Figure 4:
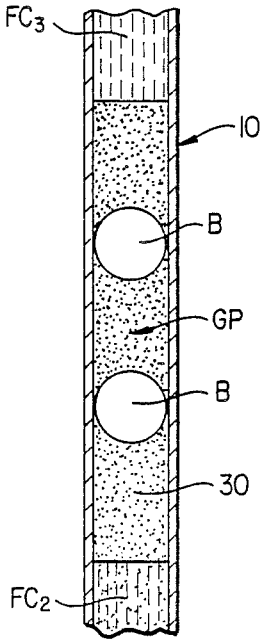
FIG. 4 is an enlargement of the dashed line area "A" of FIG. 3.

The present invention uniquely facilitates the reliable and accurate placement and formation of the perforation plugging structures utilizing plug means in the form of gel and ball plug structures GP (see FIGS. 3 and 4) which are utilized to separate within the casing 10 various fluid columns $FC_1$, $FC_2$, and $FC_3$ used in the "tailing off" process used in propping the fracture zones and forming the perforation plug structures at each of the perforation zones.

Figure 5:
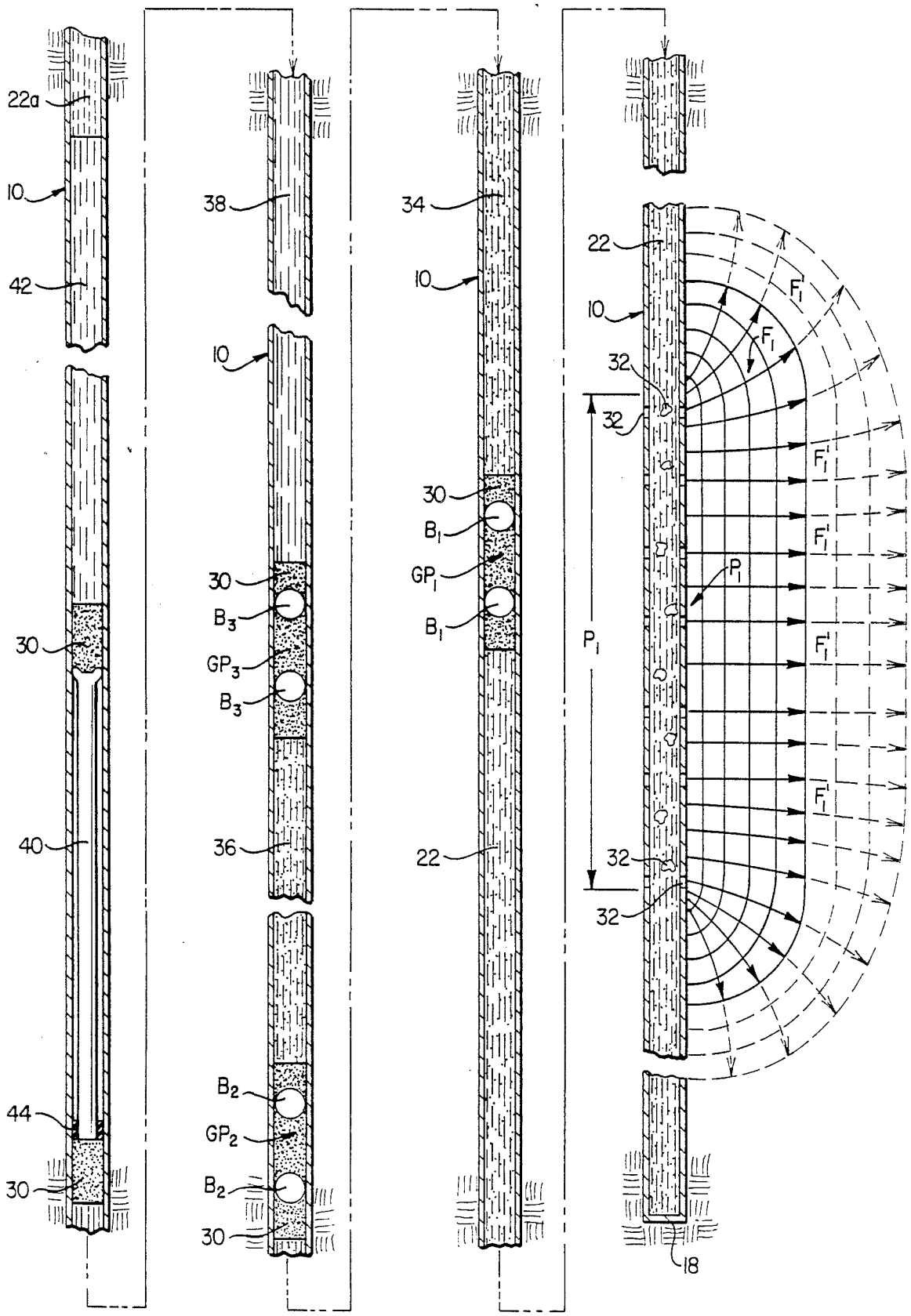
FIG. 5 is a longitudinally foreshortened cross-sectional view through the casing and illustrates a "train" of plug separated fluid columns, and a perforating gun, which are driven downwardly through the casing to prop previously created earth fractures, seal off their related casing perforations, and to automatically position the perforating gun for a subsequent fracturing shot.

Each of the gel plugs GP comprises a vertically spaced pair of casing-sized rock salt balls B immersed in a high strength, flexible sealing gel solution 30 which extends, as illustrated in FIG. 5, a short distance above and below the balls B. The gel solution 30 may be any one of many standard frac gels commercially available from frac service companies such as the Halliburton Company. Importantly, as the tailing off fluid columns are forced downwardly through the casing 10, the gel plugs P, which upwardly and downwardly bound various ones of the fluid columns, prevent mixing between vertically adjacent fluid columns and assure that the fluid columns flow "plug-like" down the casing. As will be seen, the gel plugs GP function to assure a high degree of precision in delivering the various fluid columns to a perforation zone, provide for the accurate and reliable formation of the perforation plug structures, and partially define the resulting perforation plug structures.

Figure 7:
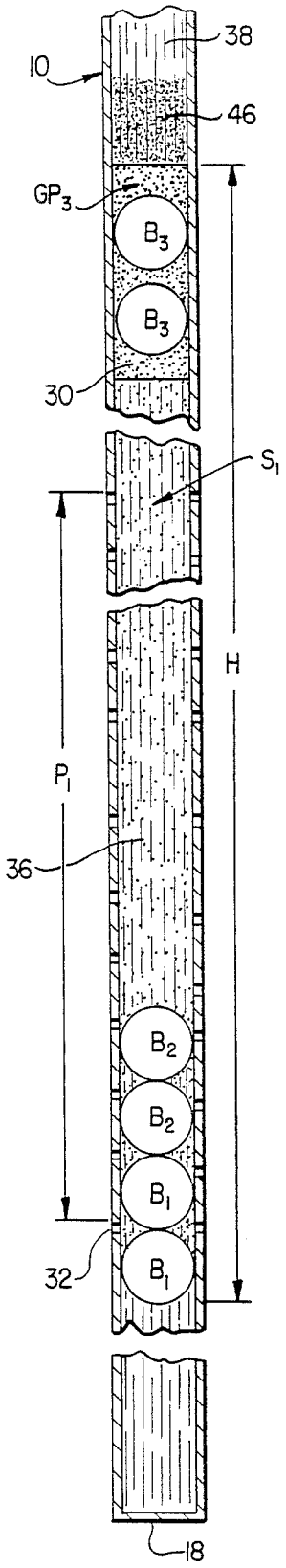
FIG. 7 is an enlarged cross-sectional view through a portion of the well casing and illustrates the manner in which one of the perforation plugging structures of FIG. 1 is formed within the casing in a manner automatically positioning the perforating gun of FIG. 6 for a subsequent fracturing shot.

To illustrate a representative perforating, fracturing, propping and perforation zone plug-off operation, reference will now be made to FIGS. 5 and 7 in which it will be assumed that the lowermost perforation zone $P_1$ has already been formed by one of the previously described fracturing processes. For purposes of discussion, it will also be assumed that the well casing 10 is of standard 5½" metal casing pipe, and that the previously formed perforation zone P1 is approximately 8' in height.

After the perforation zone $P_1$ has been formed, and the adjacent fracture zone $F_1$ has been created, a predetermined volume of frac fluid 22 is pumped, at a relatively high rate, downwardly through the casing 10 so that the frac fluid is forced outwardly through the various individual perforations 32 of the perforation zone $P_1$ into the fracture zone $F_1$ to extend the fracture area as schematically illustrated by the dashed lines $F_1'$. After a predetermined amount of the frac fluid 22 has been pumped at a relatively rapid rate down through the casing 10, the frac fluid casing inflow is temporarily terminated to permit insertion into the casing 10, in a manner subsequently described, of a fluid column, gel plug, and perforating gun "train" used to plug off the perforation zone $P_1$ and ready the casing for a subsequent perforation shot.

After this train (which may be generally referred to as a "tailing off" train) has been inserted into the casing 10, additional frac fluid $22_a$ (see the upper left corner portion of FIG. 5) is forced into the casing 10 to drive the train downwardly therethrough to sequentially prop the extended fracture zone $F_1$, seal off the perforation zone $P_1$, and position a subsequent perforating gun at a predetermined interval above the sealed off perforation zone for a subsequent perforation shot.

This "tailing off" train comprises, from bottom to top between the frac fluid columns 22 and $22_a$, a gel plug GP1 having casing size rock salt balls $B_1$; a column of concentrated proppant slurry 34; a second gel plug $GP_2$ having casing-sized rock salt balls $B_2$; a column of concentrated perforation plugging slurry 36; a third gel plug $GP_3$ having casing-sized rock salt balls $B_3$; a spacing water column 38; an eight foot long perforating gun 40 sealed at its opposite ends by quantities of the strong gel solution 30 used in the gel plugs; and a tamp water column 42. While the compositions of the various fluid columns, and their lengths, could be varied to suit the particular fracturing operation, the components of the illustrated tailing off train are as follows.

The concentrated proppant liquid column 34, bounded at its upper and lower ends by the high strength gel plugs $GP_2$ and $GP_1$, approximately 100 feet in length (a volume of about 11.89 cubic feet) and is basically a concentrated prop sand slurry of about 40% to 50% sand by volume suitable for injection into the formation fracture.

The perforation plugging slurry column 36 is approximately 25 feet in length (a volume of about three cubic feet) and comprises about 55% gelled water, 10% rock salt chunks about 1 to 2 mesh, 5% rock salt at 2 to 5 mesh, 4% rock salt at 5 to 10 mesh, 4% rock salt at 10 to 20 mesh, 5% rock salt at 40 to 70 mesh, 5% rock salt at 70 to 150 mesh, and 8% rock salt at less than 150 mesh. The distribution of particle size in this plugging slurry may be varied as found beneficial to achieve a most effective plug over the perforation zone.

The spacing water column 38, positioned between the gel 30 at the bottom of the perforating gun 40 and the gel plug $GB_3$ is formed from water containing and desired concentration of ultra-fine rock salt particles ranging from about 100 to about 400 mesh in size. The spacing water column 38 has a length corresponding to the desired vertical spacing interval between the first perforation zone $P_1$ and the next perforation zone $P_2$. For example, if the previously described approximately 100 foot spacing intervals between perforation zones are desired, the total length of the spacing water column 38 would correspondingly be on the order of about 100 feet.

The perforating gun 40 is of any desired construction, having a length of approximately 8 feet, and is provided with an appropriate annular seal structure 44 at its lower end. The tamp water column 42 directly above the gun 40 is similar in composition to the spacing water column 38, and is of any desired length. Each of the gel plugs $GP_1$, $GP_2$, and $GP_3$ is approximately 3 feet long, with its casing-size ball sealers B being spaced apart approximately 8 to 10 inches center-to-center, approximately 8 to 12 inches of the high strength flexible sealing gel 30 extending above and below the sealing balls.

With the tailing off train in place within the casing 10 as shown in FIG. 5, the casing plug structure $S_1$ (FIG. 7) is formed in the following manner. As the train is moved downwardly through the casing 10 toward the perforation zone $P_1$, the previously pumped-in frac fluid 22 is forced outwardly through the casing perforations into the fracture zone $F_1$ to form the dotted line fracture extensions $F_1'$. When the lower gel plug $GP_1$ downwardly enters the casing perforation zone $P_1$, the concentrated proppant slurry 34 also begins to be forced outwardly into the fracture zone to perform its tight pack, maximum width fracture propping function. When the lower gel plug $GP_1$ reaches the lower end of the perperation zone $P_1$ its rock salt sealing balls $B_1$ come to rest, in an abutting relationship, at the bottom of the perforation zone as indicated in FIG. 7.

The balance of the concentrated proppant fluid 34 is then squeezed outwardly through the casing perforations as the still moving gel plug $GP_2$ downwardly approaches the now stationary sealing balls $B_1$. As the middle gel plug GP2 enters the perforation zone, a lower end portion of the perforation plugging slurry 36 begins to be forced outwardly into the perforations in an upper end portion of the perforation zone $P_1$. Proppant fluid outflow through the casing perforations then terminates when the sealing balls $B_2$ come to rest atop the balls $B_1$.

Rapidly after this occurrence, the continuing outflow of perforation plugging slurry blocks the perforations to create the plug structure $S_1$ which is bounded at its lower end by the sealing balls $B_1$, and at its upper end by the still intact upper gel plug $GP_3$ positioned approximately 8–10 feet above the upper end of the perforation zone $P_1$. Downward seepage of the spacing water 38 above the upper gel plug $GP_3$ through the plug structure $S_1$ is inhibited by the filtering out, on the top of the gel plug $GP_3$, of ultra-fine rock salt particles 46 in the spacing water column (FIG. 7). In turn, this automatically positions the perforation gun 40 at the predetermined spacing interval above the perforation zone $P_1$ to ready the casing 10 for the formation of the next perforation zone $P_2$.

The use of the high strength gel and ball plug seals $GP_1$–$GP_3$ substantially prevents the undesirable mixing between the fluid columns which they sealingly separate. Accordingly, such separated fluid columns are themselves caused to flow in a "plug-like" manner down the lengthy well casing so that they arrive at their perforation "target" in an essentially undiluted form and in their intended quantities in the predetermined time sequence. This accurate and reliable formation of the casing plugging structure also assures accurate placement of each next succeeding perforation gun. While the illustrated fluid column-separating plug means have been representatively illustrated and described as comprising two spaced apart rock salt sealing balls encapsulated in a high strength gel material, it will be readily appreciated that other types of sealing and column-separating plug means could be employed if desired.

The sequential perforation, fracturing, propping and plugging process just described employs a series of perforation zones which are spaced apart along the casing at representative 100 foot intervals—intervals which may be selectively altered, of course, by selectively adjusting the height of the particular spacing water column 38. It will be appreciated that the accuracy of each successive perforating gun placement is dependent upon two primary factors—the maintenance of each of the various fluid columns in an essentially "plug-type" flow mode (facilitated by the unique gel plugs previously described), and a very accurate control over the heights of such columns. As will be seen, the present invention provides unique apparatus and methods for precisely controlling the volume (and thus the heights) of the fluid column components of each of the fluid column, seal plug and perforating gun trains forced downwardly through the well casing.

Figure 6:
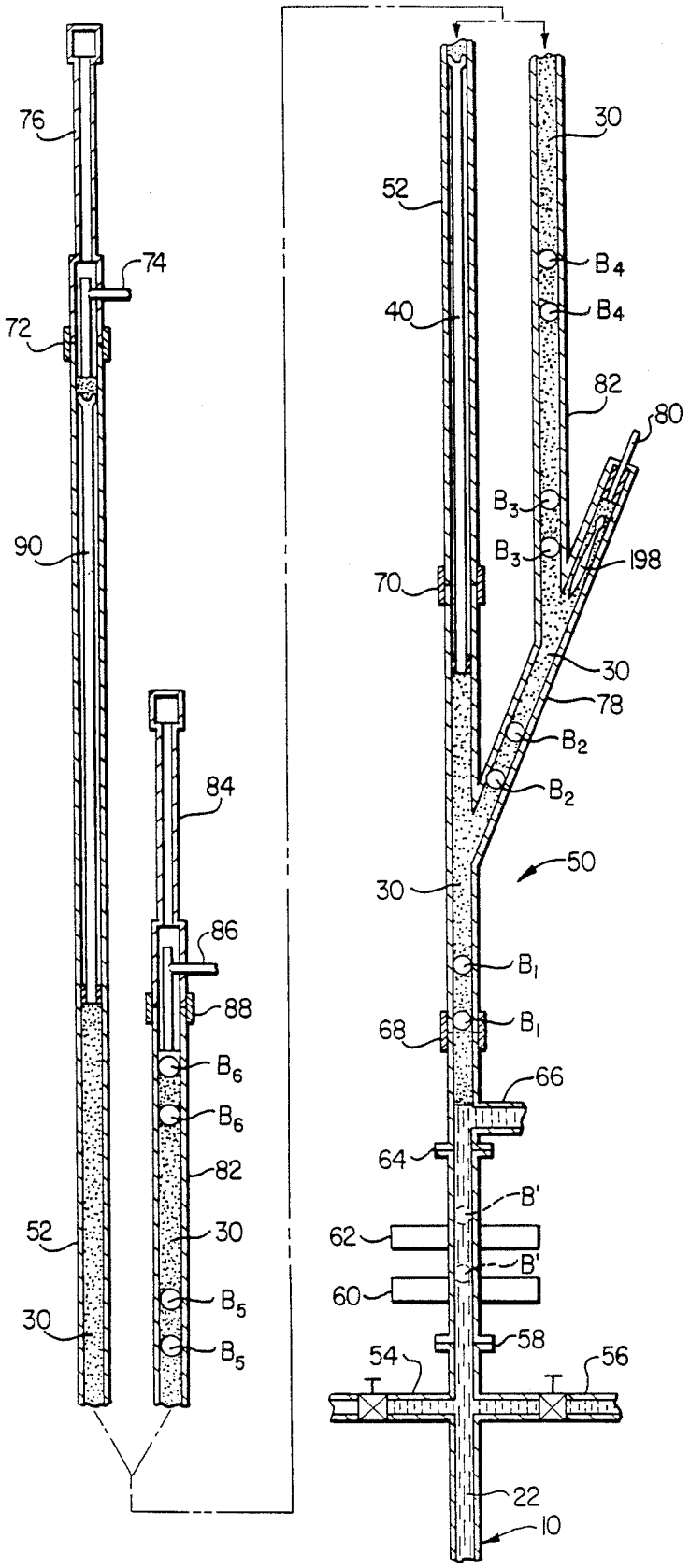
FIG. 6 is a schematic cross-sectional view through a vertically elongated well head lubricator structure used to form the fluid column and gun train of FIG. 5 and force it downwardly through the well casing.

Referring now to FIG. 6, the present invention provides, as an upper portion of the well head structure 20 (FIG. 1), a train storage, formation and delivery lubricator structure 50 which may be used to rapidly and accurately form two fluid column, plug seal and perforating gun trains and force them down the well casing 10 in a manner permitting the multi-zone fracturing and seal-off techniques just described.

The lubricator structure 50 includes a first casing-sized vertical lubricator pipe 52 which defines an upward extension of the casing 10 above the usual valved frac fluid injection lines 54 and 56, a coupling 58, a pair of blowout preventor rams 60 and 62, and a coupling 64. From bottom-to-top, the lubricator pipe 52 is provided with a fluid injection line 66, hammer unions 68, 70 and 72, a fluid injection line 74, and a lifting sub 76 at its upper end.

Communicating at its inner end with the first lubricator pipe 52 is an upwardly and outwardly angled short casing-sized connecting pipe 78 provided at its upper end with a fluid injection line 80. The lower end of a casing-sized second lubricator pipe 82 communicates with a longitudinally central portion of the connecting pipe 78 and extends upwardly therefrom generally parallel to the first lubricator pipe 52. The second lubricator pipe 82 is somewhat shorter than the first lubricator pipe 52 and has a lifting sub 84 at its upper end. Just below the lifting sub 84 the second lubricator pipe 82 is provided with a fluid injection line 86 which, in turn, is positioned immediately above a hammer union 88.

The gun and plug components of two separate tailing off trains are conveniently stored within the lubricator structure 50 for sequential formation and delivery down the well casing of the two trains in a manner which will now be described. It will be appreciated that one or more additional train component-loaded lubricator structures 50 may be provided for ready connection to the well head when the illustrated structure 50 is emptied. For purposes of this description, it will be assumed that perforation zone $P_1$ (FIG. 5) and its corresponding fracture zone S1 have just been formed, thereby readying the casing for the "tailing off" operation previously described in conjunction with FIGS. 5 and 7.

The previously described perforating gun 40, and a second perforating gun 90, are stored within the first lubricator pipe 52, with the bottom end of gun 40 being somewhat above the juncture of the lubricator pipes 52 and 78, and the top of the gun 90 being somewhat below the hammer union 72. The guns 40 and 90 are separated by high strength sealing gel material 30, such gel material extending upwardly beyond the upper gun 90, and downwardly below the lower gun 40 within the lubricator pipe 52 to a position adjacent the fluid injector line 66. As illustrated in FIG. 6, the lubricator pipes 78 and 82 are also filled with the high strength sealing gel material 30.

The sealing gel material 30 within the lubricator pipes 78 and 82 supports, in predetermined spaced relationships, six spaced pairs of casing-size rock salt sealing balls $B_1$–$B_6$ which are used to form the six gel plug components of the two tailing off trains formed in and delivered from the lubricator structure 50. The ball pair $B_1$ is positioned in a lower end portion of the pipe 52 immediatley above the fluid injection line 66, the ball pair $B_2$ is positioned within the lubricator pipe 78 adjacent its juncture with the pipe 52, the ball pair $B_3$ is positioned within a lower end of the pipe 82, and the ball pairs $B_4$–$B_6$ are positioned at spaced intervals upwardly along the remainder of pipe 82, with the ball pair $B_6$ being positioned just beneath the hammer union 88. It will be readily recognized that the gun 40 and the ball pairs $B_1$–$B_3$ correspond to the tailing off train components previously described in conjunction with FIGS. 5 and 7. The gun 90 and the ball pairs $B_4$–$B_6$, which are also stored in the lubricator structure 50, generally above the first set of train components, are used in a manner subsequently described to form a second tailing off train.

Figure 8:
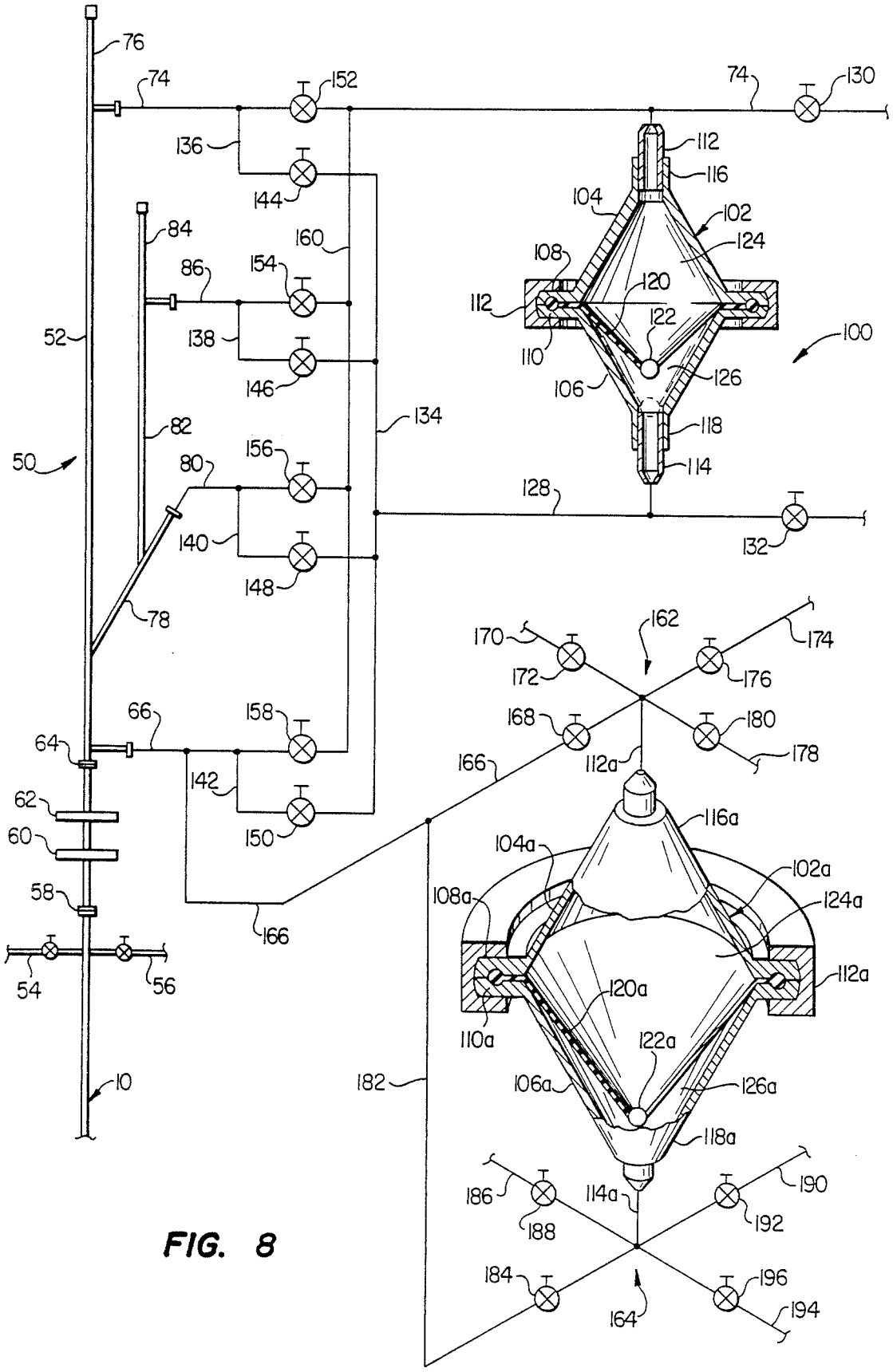
FIG. 8 is a schematic diagram of a metered fluid injection and displacement system used in conjunction with the lubricator structure of FIG. 6.

As will be seen, each tailing off train is formed, and initially forced down into the well casing 10, by injecting, in a predetermined sequence, precalculated volumes of displacement fluid (e.g. a low compressibility salt water solution), proppant slurry and perforation plugging slurry into the various inlets of the train storage and formation lubricator structure 50. To accomplish these fluid injection steps, a unique fluid injection and metering system 100 is operatively associated with the lubricator structure 50 as schematically illustrated in FIG. 8.

The fluid injection and metering system 100 includes a first metered fluid displacement vessel 102 having an internal volume of 0.3567 cubic feet. Vessel 102 is defined by a metal housing having generally conical upper and lower halves 104 and 106 provided with abutting peripheral base flanges 108 and 110 which are releasably clamped together by a suitable clamping ring structure 112. Inlet/outlet pipes 112 and 114 are respectively extended into the narrowed upper and lower open ends 116 and 118 of the vessel 102. The periphery of a flexible circular diaphragm member 120, having a centrally disposed sealing ball 122, is firmly clamped between the flanges 108 and 110.

The diaphragm 120 divides the interior of the vessel 102 into upper and lower chambers 124 and 126, and is configured to permit vertical movement of the sealing ball 122 between the inner ends of the inlet/outlet pipes 112 and 114 as representatively illustrated by the dotted line position of the diaphragm and sealing ball. With the sealing ball 122 in its lowermost position, and a fluid in the upper chamber 124, injection of a second fluid into the lower chamber 126 to drive the sealing ball 122 upwardly against the inner end of the pipe 112 forces a precisely metered amount of the upper chamber fluid outwardly through the upper pipe 112. Conversely, with the sealing ball 122 against the inner end of the upper pipe 112, and a fluid positioned within and filling the lower chamber 126, injection of a fluid into the upper chamber to drive the sealing ball 122 downwardly against the inner end of the lower pipe 114 forces a precisely metered amount of lower chamber fluid outwardly through the lower pipe 114.

The system 100 also includes a considerably larger metered fluid displacement vessel $102_a$, having an internal volume of 3.0 cubic feet, which, except for its larger size, is identical in construction to the vessel 102. The components of the vessel 102a have the same reference numerals as the vessel 102, but with the subscripts "a".

The vessels 102, 102a are operatively connected to the train storage and formation lubricator structure 50 by a valved piping system that includes the fluid injection line 74 to which the upper end pipe 112 of the vessel 102 is connected, and a fluid supply line 128 to which the lower end pipe 114 of the vessel 102 is connected. To the right of the vessel pipes 112 and 114, the lines 74 and 128 are respectively provided with valves 130 and 132. The left end of the line 128 is connected to a header line 134 having branch portions 136, 138, 140, and 142 which are respectively connected to the fluid injection lines 74, 86, 80 and 66. Respectively installed in the branch lines 136, 138, 140 and 142 are valves 144, 146, 148 and 150. To the right of their junctures with these branch lines, the fluid injection lines 74, 86, 80 and 66 are respectively provided with valves 152, 154, 156 and 158. As illustrated, the fluid injection lines 74, 86, 80 and 66, to the right of their valves, are interconnected by a branch line 160.

Four-way piping headers 162 and 164, arranged in cross configurations, are respectively connected to the upper and lower end pipes 112a and 114a of the metered fluid displacement vessel $102_a$. The upper pipe header 162 includes a line 166 provided with a valve 168 and connected to the fluid injection line 66 to the left of the valves 150 and 158, a line 170 provided with a valve 172, a line 174 provided with a valve 176, and a line 178 provided with a valve 180. The lower pipe header 164 includes a line 182 provided with a valve 184 and connected to the upper header line 166 to the left of its valve 168, a line 186 provided with the valve 188, a line 190 provided with a valve 192, and a line 194 provided with a valve 196.

The lines 74 and 128 associated with the smaller vessel 102 are connected at their right ends to a source of pressurized, low compressibility salt water solution. The header lines 170 and 186 associated with the larger vessel $102_a$ are connected to a source of pressurized proppant fluid, the header lines 178 and 194 are connected to a source of pressurized, low compressibility salt water solution, the header line 174 is a discharge line routed to the well system mud pits, and the header line 190 is connected to a source of pressurized perforation plugging slurry.

For purposes of describing the operation of the fluid injection and metering system 100 in the tailing off process, it will be assumed that the predetermined post-perforation volume of frac fluid 22 has already been flowed down the casing (via the frac injection lines 54 and 56) to enlarge the fracture zone $F_1$ (FIG. 6) previously created by frac fluid outflow through the individual casing perforations 32 in the perforation zone $P_1$.

As previously mentioned, this initial fracturing step may have been performed either by a normal hydraulic pumping technique, or by the improved "foam decompression fracturing" process disclosed in U.S. Pat. Nos. 4,633,951 and 4,718,493 incorporated herein by reference. It will further be assumed that the upper metering vessel 102 (FIG. 8) is loaded with salt water solution displacement fluid, with the sealing ball 122 positioned against the lower end of pipe 112, and that all of the valves and the fluid injection and metering system 100 are closed.

Referring now to FIGS. 6 and 8, after the predetermined volume of frac fluid 22 has been forced downwardly into the casing 10, frac fluid inflow to the casing is temporarily terminated, and the frac fluid 22 is recirculated externally of the casing and well head by a conventional recirculating system (not illustrated). Valves 130 and 146 are then opened to drive the diaphragm 120 of the vessel 102 downwardly to discharge therefrom 0.3567 cubic feet of displacement fluid which is flowed into the lubricator pipe 84 through the fluid injection line 86. This downwardly displaces all of the sealing balls $B_1$–$B_6$ a distance of three feet which moves the bottom sealing balls $B_1$ to the dotted line ball positions B' and the next adjacent sealing balls $B_2$ to the positions previously occupied by the sealing balls $B_1$. With the sealing ball pairs $B_1$ and $B_2$ downwardly displaced in this manner, the fluid injection line 66 is positioned generally centrally between the sealing ball pairs $B_1$ and $B_2$. The valves 130 and 146 are then closed.

Prior to performing the next step, the valves 176 and 188 are opened to upwardly fill the metering vessel $102_a$ with concentrated proppant slurry via line 186. During this initial concentrated proppant slurry filling operation, the upper vessel chamber $126_a$ is vented to the mud pits via the line 174. The valves 176 and 188 are then closed.

Next, the valves 172 and 184 are opened to force proppant slurry downwardly into the vessel $102_a$ via line 170, thereby causing the previously loaded 3.0 cubic feet of proppant slurry to be downwardly discharged from the vessel $102_a$ into the line 182. Proppant slurry discharged from the vessel $102_a$ in this manner is forced into the lubricator pipe 52, via lines 166 and 66, to form the bottom gel plug GP1 (FIG. 5), drive it downwardly into the casing 10, and form in the casing a concentrated proppant slurry column approximately 25 feet long directly above the downwardly driven gel plug $GP_1$. The valves 172 and 184 are then closed, and the valves 168 and 188 are opened to thereby upwardly force proppant slurry into the vessel $102_a$ and displace another 3.0 cubic feet of proppant slurry into the lubricator pipe 52 via lines 166 and 66. This drives the gel plug $GP_1$ further down into the well casing and increases the height of the concentrated proppant slurry column therein to approximately 50 feet. The valves 166 and 188 are then closed. In a similar fashion, the valve sets 172, 184 and 168, 188 are sequenced again to stroke the metering vessel $102_a$ two more times to increase the concentrated proppant slurry column height within the casing to approximately 100 feet.

With all of the valves in the system 100 closed, the valves 132 and 156 are then opened to upwardly displace the diaphragm 120 of vessel 102 and force 0.3567 cubic feet of salt water displacement fluid into the lubricator pipe 78 via lines 74, 160 and 80. This injection of displacement fluid into the lubricator pipe 78 drives the sealing ball pairs $B_2$ and $B_3$ downwardly a distance of approximately three feet so that they respectively occupy the B' and $B_1$ ball positions and straddle the fluid injector line 66. The concentrated proppant slurry column, and the lower gel plug $GP_1$ are, of course, driven an additional three feet down the casing 10. After this downward displacement of the sealing ball pairs $B_2$ and $B_3$ the valves 132 and 156 are closed. The sealing ball pairs $B_4$, $B_5$ and $B_6$ are now respectively positioned at the $B_3$, $B_4$ and $B_5$ locations indicated in FIG. 6.

The system valves are then appropriately operated to upwardly load three cubic feet of perforation plugging slurry, via line 194, into the vessel 102$_a$. Next, the valves 180 and 184 are opened to flow salt water displacement fluid downwardly into the vessel 102$_a$ via line 178, and downwardly displace the previously loaded three cubic feet of plugging slurry from the vessel 102$_a$ into the line 182. Plugging slurry displaced in this manner is forced into the lubricator pipe 52, via lines 166 and 66, to form the middle gel plug $GP_2$, force it downwardly into the well casing, and form directly above the gel plug $GP_2$ a 25 foot column of plugging slurry within the casing 10. The valves 180 and 184 are then closed.

Valves 130 and 150 are then opened to displace 0.3567 cubic feet of salt water displacement fluid into line 128 and into the lubricator pipe 52 via lines 134, 142 and 66 to form a clean water "pad" in the lubricator pipe 52 just below the sealing balls $B_3$. A portion of this displacement fluid also is used to cleanse the plugging slurry discharge line from the vessel 102$_a$. After this has occurred, the valves 130 and 150 are closed.

Next, the valves 132 and 156 are opened to inject 0.3567 cubic feet of salt water displacement fluid through the line 80 into the lubricator pipe 78 to thereby move the sealing ball pair $B_3$ downwardly through the lubricator pipe 52 to the dotted line ball position B' below the fluid injector line 64. The valves 132 and 156 are then closed.

Then, an alternate sequencing of the valve sets 168, 196 and 180, 184 is used to stroke the diaphragm 120$_a$ of the vessel 102$_a$ four times to inject 12 cubic feet of salt water into the lubricator pipe 52 to form the upper gel plug $GP_3$ (FIG. 5), drive it downwardly into the casing 10, and form a spacing water column approximately 100 feet long directly above the gel plug $GP_3$.

As previously mentioned, this 100 foot long spacing water column will ultimately position the perforating gun 40 a corresponding height above the perforation zone $P_1$. However, this formation of the elongated spacing water column may be eliminated, or a substantially lesser amount of salt water may be injected into the casing, to space the perforating gun 40 much closer to the perforation zone $P_1$.

After the formation in the casing 10 of the water spacing column, both of the perforating guns 40 and 90 are displaced approximately 12 feet downwardly through the lubricator pipe 52 by alternately sequencing the valve sets 130, 144 and 132, 152 to stroke the diaphragm 120 of the metering vessel 102 four times. This results in the injection of 1.427 cubic feet of salt water into the top of the lubricator pipe 52 via line 74. The resulting 12 foot downward displacement of both of the perforating guns positions the lower end of the upper gun 90 at the position previously occupied by the lower end of the lower gun 40, and positions the upper end of the gun 40 somewhat below the fluid injection line 66.

The bottom perforating gun 40 is then displaced further downwardly by a distance of 12 feet, to a position below the well head frac lines 54 and 56 by alternately sequencing the valve sets 130, 148 and 132, 156 to stroke the displacement vessel 102 four more times.

Next, the 100 foot salt water tamp column is formed directly above the perforating gun 40 by alternately sequencing the vessel 102$_a$ valve sets 180, 184 and 196, 168 to stroke the displacement vessel 102$_a$ four times and drive the displaced salt water solution into the lubricator pipe 52 through the fluid injection line 66.

With the tailing off train formed within the casing 10 in this manner, as illustrated in FIG. 6, the upper frac fluid 22$_a$ (FIG. 5) is forced into the well casing to force the tailing off train downwardly therethrough to form the plug structure at the perforation zone $P_1$ as previously described, and precisely position the perforating gun 40 a predetermined distance upwardly from the now plugged perforation zone $P_1$.

After the plugging of perforation zone $P_1$, and the placement of the perforating gun 40, a detonation spear 198, supported within an outer end portion of the lubricator pipe 78 as illustrated in FIG. 6, is released and dropped into the well casing 10 to fire the perforating gun 40 in a conventional manner. After the dropped spear 198 has passed the blowout preventors 60 and 62, they are closed to await the firing of the gun 40. When the gun is fired and a predetermined volume of frac fluid 22 has been pumped into the casing, then the blowout preventors are again opened to ready the surface system for the formation and delivery into the well casing of the second tailing off train, the components of which are conveniently stored in the lubricator structure 50. This second train may be then formed in a manner similar to that used to form and deliver the first tailing off train. The foregoing valve sequencing, fluid metering and injection process, while somewhat cumbersome to describe, is very easily performed, particularly when the valve sequencing is automated in a suitable fashion.

The combination of the "plug-like" flow of each fluid column down the well casing, which essentially eliminates the mixing of adjacent column fluids, and the volumetric fluid injection precision afforded by the fluid injection and metering system 100 in cooperation with the train storage and formation structure 50, essentially eliminates the problems, limitations and disadvantages heretofore associated with conventional tailing off processes.

It will readily be appreciated by those skilled in this art that a variety of structural modifications could be made to the train storage and formation structure 50 and/or the fluid injection and metering system 100 if desired. For example, while the illustrated structure 50 stores the gel plug and perforating gun components of the two tailing off trains in a side-by-side fashion, a single elongated lubricator pipe could be utilized in which the sealing ball and perforating gun components of one train could be stored directly above the sealing ball and perforating gun components of the second train. This single lubricator pipe could, if desired, be made sufficiently long to house the sealing ball and perforating gun components of more than two tailing off trains.

Additionally, while the displacement vessels 102 and 102$_a$ have been illustrated as having generally conically shaped halves, and provided with diaphragms 120 and 120$_a$, the vessels could be given alternative configurations, and the diaphragms could be replaced with movable displacement pistons or the like.

Moreover, while the illustrated gel and ball sealing plugs used to separate and isolate adjacent fluid columns in the casing are particularly advantageous in this particular application, they could be replaced with alternate plug seal means having different compositions and configurations. One advantage, though, of using the illustrated rock salt balls is that over time they will dissolve, by circulating water or the production of formation water, thereby facilitating the inflow of production fluid 24 (FIG. 2) for delivery to the well head 20. Alternatively, the rock salt balls, which assist in forming the various plug structures as illustrated in FIG. 7, may also be very easily drilled out to facilitate such production fluid inflow into the casing 10.

The foregoing detailed description is to be clearly understood as being given by way of illustration and example only, the spirit and scope of the present invention being limited solely by the appended claims.

What is claimed is:

1. A method of accurately and reliably sealing off a relatively short earth fracturing perforation zone which is formed in a well casing, has upper and lower ends, and is positioned adjacent a subterranean fracture zone, the well casing having a first fluid column therein with an upper end positioned above the perforation zone, said method comprising the steps of:

forming a perforation plugging slurry column, having a predetermined volume, within the casing above the first fluid column;

forming a second fluid column within the casing above said perforation plugging slurry column;

interposing first sliding plug seal means between the first fluid column and said perforation plugging slurry column, said first sliding plug seal means being operative, during forced downward movement of said perforation plugging slurry column, to prevent significant intermixing between said perforation plugging slurry column and the first fluid column;

interposing second sliding plug seal means between said perforation plugging slurry column and said second fluid column, said second sliding plug seal means being operative, during forced downward movement of said perforation plugging slurry column and said second column, to prevent significant intermixing between said perforation plugging slurry column and said second fluid column; and forcing said second fluid column downwardly through the well casing to drive said perforation plugging slurry column, in an essentially plug-like longitudinally undistorted configuration, toward the perforation zone, and then causing it to enter the perforation zone and form therealong a perforation plug structure defined in part by a longitudinal portion of said perforation plugging slurry column.

2. The method of claim 1 wherein each of said first and second sliding plug seal means comprises:

a column of high strength, flexible sealing gel, and casing-sized solid seal means positioned within a longitudinally intermediate portion of said sealing gel column for structurally reinforcing the same.

3. The method of claim 2 wherein:

said casing-sized solid seal means comprise a plurality of mutually spaced, casing-sized solid sealing elements.

4. The method of claim 3 wherein:

said sealing elements have generally spherical configurations.

5. The method of claim 4 wherein:

said sealing elements are formed from a rock salt material.

6. A method of sealing off an earth fracturing perforation zone which is formed in a well casing, has upper and lower ends, and is positioned adjacent a subterranean fracture zone, the well casing having a fluid column therein, said method comprising the steps of:

positioning in an upper end portion of the well casing a tailing off train including:

first sliding plug seal means, positioned adjacent the upper end of the fluid column, for slidably and sealingly engaging an annular interior surface portion of the well casing, a fracture proppant slurry column extending upwardly from adjacent said first sliding plug seal means, second sliding plug seal means, positioned adjacent the upper end of said fracture proppant slurry column, for slidably and sealingly engaging an annular interior surface portion of the well casing, a perforation plugging slurry column extending upwardly from adjacent said second sliding plug seal means, and third sliding plug seal means, positioned adjacent the upper end of said perforation plugging slurry column, for slidably and sealingly engaging an annular interior portion of the well casing; and driving said tailing off train downwardly through the casing to form at the perforation zone a plug-off structure which longitudinally spans the perforation zone and is defined by at least portions of said first and second sliding plug seal means in close adjacency with one another at the lower end of the perforation zone, said third sliding plug seal means positioned above said first and second sliding plug seal means, and at least a portion of said perforation plugging slurry column extending downwardly from said third sliding plug seal means.

7. The method of claim 6 wherein each of said first, second and third sliding plug seal means comprises:

a column of high strength, flexible sealing gel material; and at least one casing-sized solid sealing element positioned in a longitudinally intermediate portion of said sealing gel material column.

8. The method of claim 7 wherein:

said at least one casing-sized solid sealing element has a generally spherical configuration.

9. The method of claim 8 wherein:

said at least one casing-sized solid sealing element is formed from a rock salt material.

10. The method of claim 6 wherein each of said first, second and third sliding plug seal means comprises:

a column of high strength, flexible sealing gel material; and a mutually spaced plurality of casing-sized solid sealing elements positioned in a longitudinally intermediate portion of said sealing gel material column.

11. The method of claim 10 wherein:

said mutually spaced plurality of casing-sized solid sealing elements have generally spherical configurations.

12. The method of claim 11 wherein:

said mutually spaced plurality of casing-sized solid sealing elements are formed from a rock salt material.

13. A method of rapidly and accurately sealing off an earth fracturing perforation zone previously formed in a well casing extending downwardly through a production fluid-bearing subterranean formation, propping a formation fracture zone adjacent the perforation zone, and positioning a perforating gun within the casing at a predetermined interval above the sealed off perforation zone, the casing having therein a frac fluid column extending upwardly beyond the upper end of the perforation zone, said method comprising the steps of:

positioning in the well casing a tailing off and gun placement train extending upwardly from the upper end of the frac fluid column and, from bottom to top, including:

first sliding plug seal means, positioned adjacent the upper end of the frac fluid column, for slidably and sealingly engaging an annular interior surface portion of the well casing, a fracture proppant slurry column extending upwardly from adjacent said first sliding plug seal means, second sliding plug seal means, positioned adjacent the upper end of said fracture proppant slurry column, for slidably and sealingly engaging an annular interior surface portion of the well casing, a perforation plugging slurry column extending upwardly from adjacent said second sliding plug seal means, third sliding plug seal means, positioned adjacent the upper end of said perforation plugging slurry column, for slidably and sealingly engaging an annular interior portion of the well casing, a spacing fluid column extending upwardly from adjacent said third sliding plug seal means, an elongated perforating gun having a lower end portion positioned above the upper end of said spacing fluid column and slidably sealed against the interior surface of the casing, and a tamp fluid column extending upwardly from adjacent the upper end of said perforating gun; and driving said tailing off and gun placement train downwardly through the casing to form at the perforation zone a plug-off structure which longitudinally spans the perforation zone and is defined by at least portions of said first and second sliding plug seal means in close adjacency with one another at the lower end of the perforation zone, said third sliding plug seal means positioned above said first and second sliding plug seal means, and at least a portion of said perforation plugging slurry column extending downwardly from said third sliding plug seal means.

14. The method of claim 13 wherein each of said first, second and third sliding plug seal means comprises:

a column of high strength, flexible sealing gel material; and at least one casing-sized solid sealing element positioned in a longitudinally intermediate portion of said sealing gel material column.

15. The method of claim 14 wherein:

said at least one casing-sized solid sealing element has a generally spherical configuration.

16. The method of claim 15 wherein:

said at least one casing-sized solid sealing element is formed from a rock salt material.

17. The method of claim 13 wherein each of said first, second and third sliding plug seal means comprises:

a column of high strength, flexible sealing gel material; and a mutually spaced plurality of casing-sized solid sealing elements positioned in a longitudinally intermediate portion of said sealing gel material column.

18. The method of claim 17 wherein:

said mutually spaced plurality of casing-sized solid sealing elements have generally spherical configurations.

19. The method of claim 18 wherein:

said mutually spaced plurality of casing-sized solid sealing elements are formed from a rock salt material.

20. A sliding plug seal structure interposable between facing end portions of first and second cylindrical fluid sections, disposed in a pipe having an inside diameter, to prevent significant intermixing between said facing end portions when said first and second cylindrical fluid sections are driven axially along the interior of the pipe, said sliding plug seal structure comprising:

a cylindrical section of high strength, flexible sealing gel material having a diameter equal to the inside diameter of the pipe; and at least one pipe-sized solid sealing element positioned within a longitudinally intermediate portion of said cylindrical sealing gel material section.

21. The sliding plug seal structure of claim 20 wherein:

said at least one pipe-sized solid sealing element includes a spaced plurality of solid sealing elements.

22. The sliding plug seal structure of claim 21 wherein:

said spaced plurality of solid sealing elements have generally spherical configurations.

23. The sliding plug seal structure of claim 22 wherein:

said spaced plurality of solid sealing elements are formed from a rock salt material.

24. For use in conjunction with a well casing extending into a subterranean, production fluid-bearing formation and having formed therein an earth fracturing perforation zone positioned adjacent a fracture zone within the subterranean formation, apparatus for forming, and driving downwardly through the well casing a tailing off and perforating gun train adapted, upon delivery to and into the perforation zone, to prop the fracture zone, plug the perforation zone, and position a perforating gun a predetermined distance upwardly within the casing from the plugged perforation zone, said tailing off and perforating gun placement train, from bottom to top, including:

a casing-sized first sliding seal plug structure, a fracture proppant slurry column, a casing-sized second sliding seal plug structure, a perforation plugging slurry column, a casing-sized third sliding seal plug structure, a spacing fluid column, an elongated casing perforating gun having a casing-sized slidable sealing element operatively associated therewith, and a tamp fluid column, said apparatus comprising:

an elongated, casing diameter lubricator pipe structure having a lower end outlet portion communicatible with an upper end portion of the well casing, and inlet means for receiving pressurized fluids from sources thereof and flowing the received fluids into the interior of said lubricator pipe structure at predetermined, longitudinally spaced locations therein, said lubricator pipe structure having stored therein, along its length, the perforating gun and sliding plug seal plug structure components of said tailing off and perforating gun placement train; and metered fluid injection means, interconnectable between said inlet means and sources of pressurized displacement fluid, fracture proppant slurry and perforation plugging slurry, for injecting metered volumes of displacement fluid, fracture proppant slurry and perforation plugging slurry into said inlet means, in a predetermined sequence, to sequentially form within said lubricator pipe structure successively higher longitudinal portions of said tailing off and perforating gun placement train and drive them downwardly through said lower end outlet portion of said lubricator pipe structure.

25. The apparatus of claim 24 wherein:

the perforating gun and sliding seal plug structure components of at least one additional tailing off and perforating gun placement train are also stored within said lubricator pipe structure, and said metered fluid injection means are operative to form and successively deliver from said lubricator pipe structure at least two tailing off and perforating gun placement trains.

26. The apparatus of claim 24 wherein:

said perforating gun, and portions of said first, second and third sliding seal plug structures are stored in a mutually spaced relationship within said lubricating pipe structure, and the interior lubricator pipe structure spaces between said perforating gun and portions of said first, second and third sliding seal plug structures are filled with a high strength, flexible sealing gel material.

27. The apparatus of claim 25 wherein:

said portions of said first, second and third sliding seal plug structures each comprise at least one casing-sized solid sealing element.

28. The apparatus of claim 27 wherein:

each of said at least one casing-sized sealing element comprises a mutually spaced plurality of casing-sized solid sealing elements.

29. The apparatus of claim 28 wherein:

each of said casing-sized solid sealing elements has a generally spherical configuration.

30. The apparatus of claim 29 wherein:

each of said casing-sized solid sealing elements is formed from a rock salt material.

31. The apparatus of claim 24 wherein said metered fluid injection system includes:

first and second metered displacement vessels each having an oppositely disposed pair of inlet/outlet openings, and an internal displacement member pressure-strokable between opposite limit positions to discharge through one of said inlet/outlet openings a precisely metered volume of fluid, essentially equal to the interior volume of the vessel, outwardly through the other of said inlet/outlet openings from one side of the displacement member in response to a corresponding driving fluid inflow to the vessel on the other side of the displacement member, a piping system operatively interconnecting said lubricator pipe structure inlet means and said inlet/-outlet openings of said first and second metered displacement vessels, and connectable to sources of pressurized displacement fluid, fracture proppant slurry and perforation plugging slurry, and valve means operatively connected in said piping system and sequencable to stroke said first and second metering vessels in a manner causing them to inject said metered volumes of displacement fluid, fracture proppant slurry and perforation plugging slurry into said lubricator pipe structure inlet means in said predetermined sequence.

32. The apparatus of claim 31 wherein: each of said displacement member is a flexible diaphragm member.

33. A method of forming, and delivering downwardly into a well casing for use in an earth fracturing process, a tailing off and perforating gun placement train including, from bottom to top, a first casing-sized sliding seal plug structure; a fracture proppant slurry column; a second casing-sized sliding seal plug structure; a perforation plugging slurry column; a third casing-sized seal plug structure; a spacing fluid column; an elongated casing perforating gun; and a tamp fluid column, said method comprising the steps of:

storing the perforating gun and sliding plug seal structure components of the train in a stacked relationship within a vertically extending storage container structure positioned above and internally communicating with an upper end portion of the well casing; and injecting, in a predetermined sequence, metered volumes of pressurized displacement fluid, fracture proppant slurry and perforation plugging slurry into said storage container, at vertically spaced locations thereon, in a manner sequentially forming within said storage container structure successively higher longitudinal portions of the train and discharging them downwardly from said storage container structure.

34. An earth fracturing process for stimulating production fluid flow from a production fluid-bearing subterranean formation, said method comprising the steps of:

extending a well casing downwardly through the earth into the subterranean formation;

filling the casing with a frac fluid;

lowering a first perforating gun into the casing to a position vertically within the subterranean formation;

firing the lowered first perforating gun to create a first casing perforation zone therein;

flowing frac fluid outwardly through said first casing perforation zone in a manner creating adjacent thereto a first fracture zone in the subterranean formation;

forming a tailing off and perforating gun placement train and forcing it downwardly through the casing to prop said first fracture zone, plug off said first casing perforation zone, and position a second perforating gun within the well casing a predetermined distance above the plugged first casing perforation zone, said tailing off and perforating gun placement train, from bottom to top, including:

a first casing-sized sliding seal plug structure,
a fracture proppant slurry column,
a second casing-sized sliding seal plug structure,
a perforation plugging slurry column,
a third casing-sized sliding seal plug structure,
a spacing fluid column,
a second perforating gun, and
a tamp fluid column;

firing said second perforating gun to create a second casing perforation zone; and flowing frac fluid outwardly through said second casing perforation zone in a manner creating adjacent thereto a second fracture zone in the subterranean formation.

* * * * *